United States Patent [19]

Cicin-Sain

[11] Patent Number: 4,707,935

[45] **Date of Patent: * Nov. 24, 1987**

[54] SELF-PROPELLED MACHINE TO DRESS AND RE-DISTRIBUTE RAILWAY ROAD BED BALLAST

[75] Inventor: Ivo Cicin-Sain, Bussigny-Laus, Switzerland

[73] Assignees: Danieli & C. Officine Meccaniche SpA; CLM Impianti Tecnici Industriali SpA, both of Buttrio, Italy

[ * ] Notice: The portion of the term of this patent subsequent to Nov. 17, 2004 has been disclaimed.

[21] Appl. No.: 737,867

[22] Filed: May 28, 1985

[30] Foreign Application Priority Data

Jun. 7, 1984 [IT] Italy ..... 83366 A/84
Jun. 7, 1984 [IT] Italy ..... 83365 A/84

[51] Int. Cl.[4] ..... E02F 5/22
[52] U.S. Cl. ..... 37/105; 171/16
[58] Field of Search ..... 37/104, 105; 171/16

[56] References Cited

U.S. PATENT DOCUMENTS

| | | | |
|---|---|---|---|
| 1,469,464 | 10/1923 | Ursino | 37/104 |
| 3,007,264 | 11/1961 | Stanton | 37/104 |
| 3,579,873 | 5/1971 | Kershaw | 37/105 |

FOREIGN PATENT DOCUMENTS

| | | |
|---|---|---|
| 359112 | 10/1980 | Austria . |
| 0061227 | 3/1982 | European Pat. Off. . |
| 92886 | 11/1983 | European Pat. Off. . |
| 1243227 | 12/1967 | Fed. Rep. of Germany . |
| 1938890 | 7/1969 | Fed. Rep. of Germany . |
| 550282 | 3/1972 | Switzerland . |
| 600043 | 6/1978 | Switzerland . |

*Primary Examiner*—Edgar S. Burr
*Assistant Examiner*—Moshe I. Cohen
*Attorney, Agent, or Firm*—Wegner & Bretschneider

[57] ABSTRACT

Self-propelled machine (10) to dress and re-distribute railway road bed ballast, which is suitable for the operations of flattening and forming such road beds and comprises a wheeled (12–13) frame (11), a motor (14) and a cab (15) with windows, and also includes a forming unit (17), a unit (18) to transfer ballast and a brush unit (19) with rotary brush, the forming unit (17) having at least one rotary adjustable forming drum (23–24).

9 Claims, 7 Drawing Figures

SELF-PROPELLED MACHINE TO DRESS AND RE-DISTRIBUTE RAILWAY ROAD BED BALLAST

This invention concerns a self-propelled machine to dress and re-distribute railway road bed ballast. To be more exact, the invention concerns a self-propelled machine suitable for carrying out the flattening and shaping of road beds for railways.

As is known, the upkeep of such road beds entails flattening and/or shaping operations, particularly for the portions of the road bed at the side of the rail.

It also involves the transfer of ballast from one side to the other of the railway track and from or to the middle of the track.

Various machines are known in the art which are intended for the operations of shaping and adjusting the railway road bed. For instance, machines are known which comprise lateral blades to form the edges of the road bed. Such machines comprise also a system of orientable frontal blades through which it is possible to transfer ballast from one side of the railway line to the other.

But this operation requires at least two passes so as to be performed correctly. In fact, it is necessary to move the ballast first from one side of the line to the middle and then to move the ballast thus collected in the middle of the line towards the other side of the line.

A machine is known which is the subject of European patent application No. A-0061227 and which has in its lower part a system of blades to form the road bed and also a conveyor belt to lift the ballast located in a central position.

No. EP-A-0092886 discloses a dressing machine for ballast with rotary dressing drums. Such rotary drums are fitted to arms which can be retracted within the maximum overall bulk permitted for travelling purposes. The drums cannot be adjusted for inclination in relation to the arms and serve to shape the outermost flat portion of the ballast. The sloped portion of the ballast is shaped by ploughs positioned at the lower part of the arms. Brushes are also included to clean the zone of the rails.

No. DE-A-1938890 discloses a machine which comprises on each side a lateral orientable plough which cooperates with a ramp passing over the rails and with a bladed transfer device arranged above the ramp. This text deals essentially with a device to transfer metalling from the sides of the railway line towards its centre.

U.S. Pat. No. 3,579,873 discloses a machine able to work on rails and also able to move on roads, such machine having frontal ploughs and lateral disk ploughs for the upkeep of the ballast. A brush is included at the rear of the machine for the final cleaning operation. This machine does not comprise scarifiers nor rotary bladed drums and is based wholly on the principle of a plough.

No. CH-A-600043 discloses a machine with frontal ploughs and with lateral ploughs which can be adjusted for height, inclination and lateral opening. A finisher brush is also included.

No. CH-A-550282 discloses a machine with frontal ploughs and lateral tracked scarifiers which can be adjusted for height and inclination. A rear brush is also included.

No. DE-A-1243227 discloses a machine with transverse and lengthwise brushes and with means (5) able to compact the ballast.

U.S. Pat. No. 3,007,264 discloses a machine with brushes positioned between and outside the rails. This machine serves essentially to take excess metalling by means of chains with buckets cooperating with the brushes.

Pat. AT No. 359.112 concerns a machine to transfer the road bed ballast, this machine being equipped with a system of movable blades, which can be displaced to form suitable channels to convey the ballast below the machine itself.

The lateral blades are positioned behind the central blades and therefore it is not possible to transfer the ballast and to level the road bed in one and the same pass.

This machine and others do not make possible an efficient removal of ballast at the central portion of recessed and two-piece sleepers. Moreover, such machines do not enable all the maintenance operations to be carried out in one pass alone.

Furthermore, such machines do not provide very good visibility of the working zone, particularly so when operating with the lateral blades.

It is the purpose of the present invention to provide a machine to dress and re-distribute railway road beds which is intended to overcome the drawbacks relating to known machines.

In particular, the present invention has the purpose of obtaining the transfer and flattening operations with one single pass and with great working efficiency and simplicity.

Moreover, it is a purpose of the invention to enable the road bed to be perfectly formed and the ballast to be redistributed even when the sleepers are made of concrete and are recessed.

The invention is also intended to permit excellent visual control of such operations by the driver without the latter having to leave his driving seat.

The dressing machine of the invention comprises three separate work sets or units.

The first work unit of the dressing machine of the invention has, instead of the traditional forming blades, two rotatable drums to perform lateral forming. In a preferred embodiment these drums have different diameters.

The drum with the smaller diameter is, in fact, intended to work on the inner side between two railway tracks at the same time as the other drum is working on the outer side, and to work there without going beyond the working gauge of the zone of action according to the regulations in force, the purpose being that of not disturbing any traffic on the neighbouring railway track.

Instead, where there is only one railway track, the drums can have the same diameter as each other.

The machine can possibly be equipped with a set of interchangeable drums having various diameters.

The two drums have an orientation capable of being adjusted to suit the profile which it is desired to apply to the side of the road bed.

The drums themselves can be raised to adjust the height of the road bed and can also be turned upside down into a position for their movement to another working area.

In such a position the assemblage consisting of the drums and relative support arms does not protrude beyond the clearance gauge laid down in the regulations.

A second work unit is located at a position substantially at the middle of the machine. This unit is a central unit to re-distribute the ballast and consists of two ploughs or blades, each of them positioned on one side of the machine, in a preferred embodiment.

Such blades have the task of delivering ballast to the central zone of the railway line from one or the other side respectively according to the angle applied to them by the driver. For this purpose the machine includes two ramps or bridge elements which cover the rails partially in the section of line on which work is proceeding, so as to enable the ballast to be passed over the rails.

A rotatable transfer drum is included at a central position between such two blades and has a set of protrusions or equipment able to move the ballast.

By rotating in one direction or the other this drum causes transfer of the ballast from one or the other side of the line.

This central drum can be oriented advantageously by having its axis tilted towards the front or rear of the machine. The purpose of this is to form a substantially concave surface to engage the ballast, with a profile corresponding to the projection of the circular base of the drum on a vertical plane.

Such orientation capability serves, as we shall see, for working in the central recessed portion of recessed concrete sleepers and two-piece sleepers or the like.

At the end of the rear side of the machine is located a large brush to smooth the road bed and to clean sleepers and attachments.

This large brush is known in itself but the invention arranges advantageously for it to be embodied with several articulated sections. This enables the brush to be adapted to the recessed shape of some types of concrete sleepers and two-piece sleepers.

In fact, conventional brushes with their cylindrical shape and rigid shaft do not permit adequate cleaning of recessed sleepers.

In the central portion this brush can be linked to an auxiliary rotatable brush that lifts the ballast or to a central blade that lifts the ballast.

Such central blade may possibly and advantageously be capable of being adjusted in height for adaptation to various types of sleepers, including the two-piece type.

In a preferred embodiment the forming and transfer units are supported advantageously on one single central beam. In this embodiment the positioning of the work units described is kept constantly under excellent visual control by the driver.

In an alternative embodiment the frame can be provided with two parallel beams; in this lay-out the operations can be controlled visually in the zone between such two beams and also outside them.

This invention is therefore embodied with a self-propelled machine to dress and re-distribute railway road bed ballast, which is suitable for the operations of flattening and forming such road beds and comprises a wheeled frame, a motor and a cab with glass windows and is characterized by including a forming unit, a unit to transfer ballast with orientable blades and a brush unit with a rotatable brush, such forming unit having at least one rotatable and adjustable forming drum.

We shall described hereinafter, as a non-restrictive example, a preferred embodiment of the invention with the help of the attached figures, in which.

Figure 1:
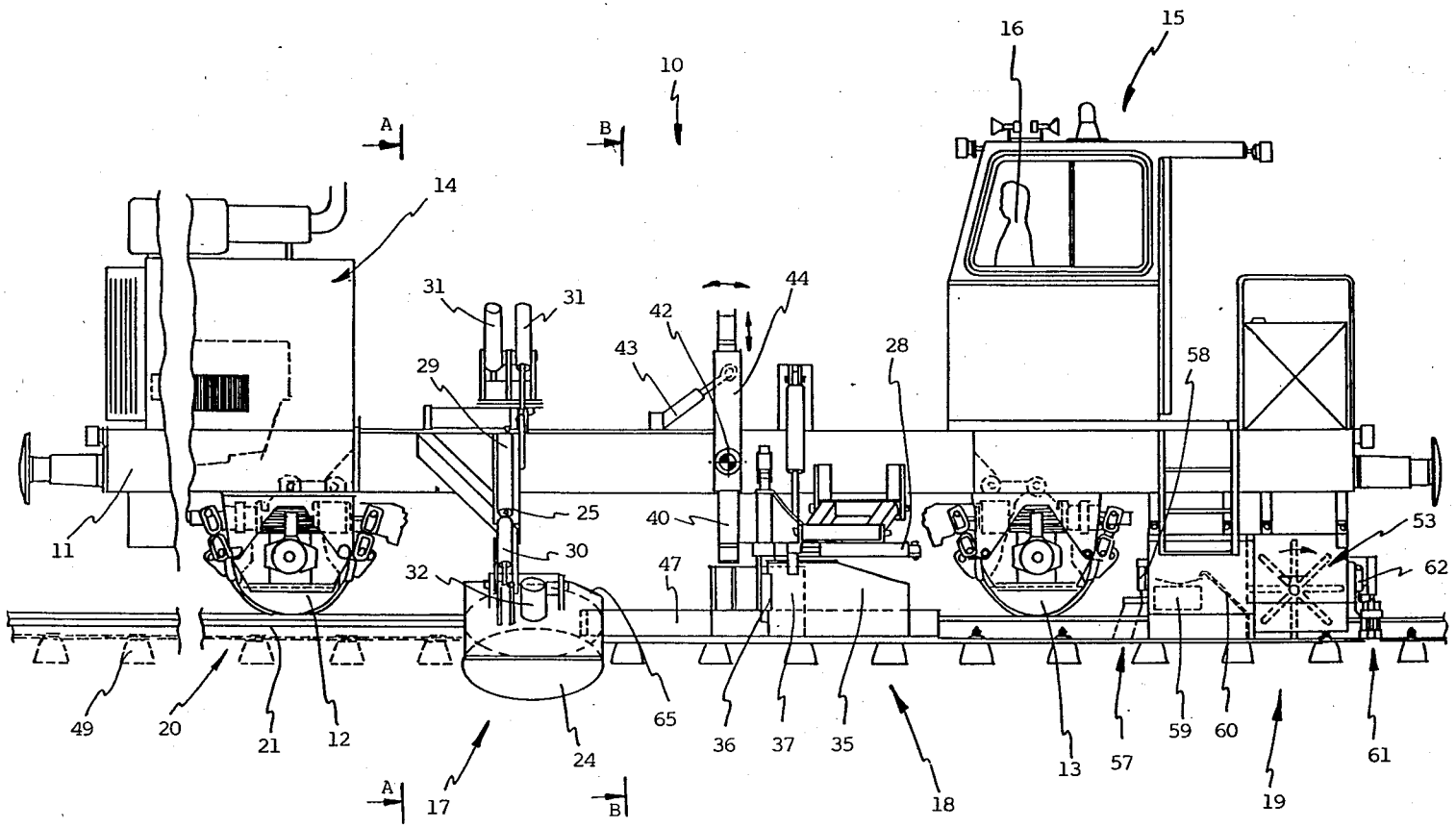
FIG. 1 is a side view of the dressing machine of the invention.
Figure 2:
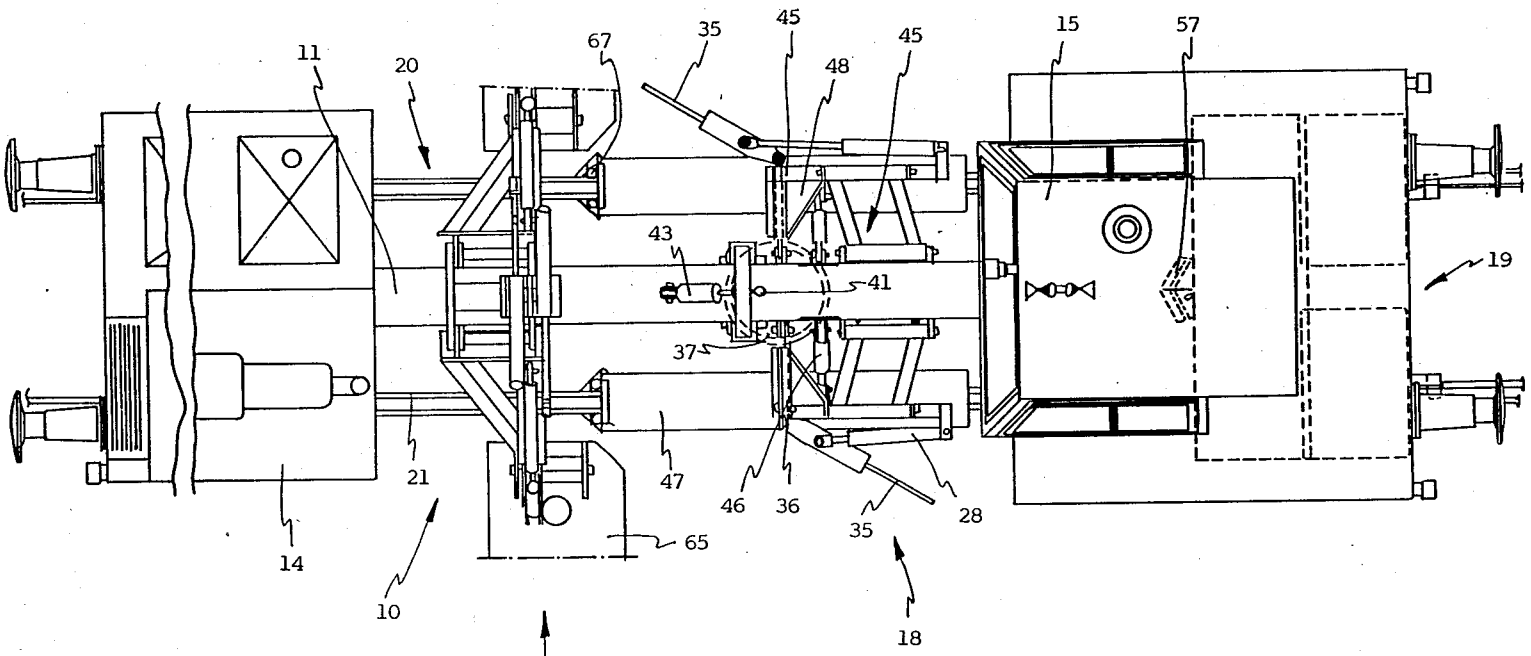
FIG. 2 is a plan view of such machine.

In FIGS. 1 and 2 a dressing machine, indicated generically with 10, is composed of a frame 11 consisting advantageously of one single beam, which is preferably a box-type beam.

As can be seen in particular in the plan view of FIG. 2, this embodiment enables a driver 16 in a cab 15 with glass windows to control visually the operations of forming and transferring the ballast in an excellent manner.

In a variant which is not shown here it is possible to provide a frame having two parallel beams; in such a lay-out the working zone can be seen through the space between such two beams as well as at their sides.

In its front portion the frame 11 supports a motor unit 14 that provides motion for front wheels, which in this example are drive wheels, 12.

The frame 11 has also rear wheels 13, which too can be powered or can be idler wheels.

The machine 10 has on its lower side three separate work units.

Starting from the front of the machine and proceeding towards its rear, it is possible to distinguish a forming unit 17, a central transfer unit 18 and lastly a brush unit 19.

The forming unit 17 has the task of forming the portions of road bed at the sides of a railway line 20 according to the required geometric conformation.

Figure 3:
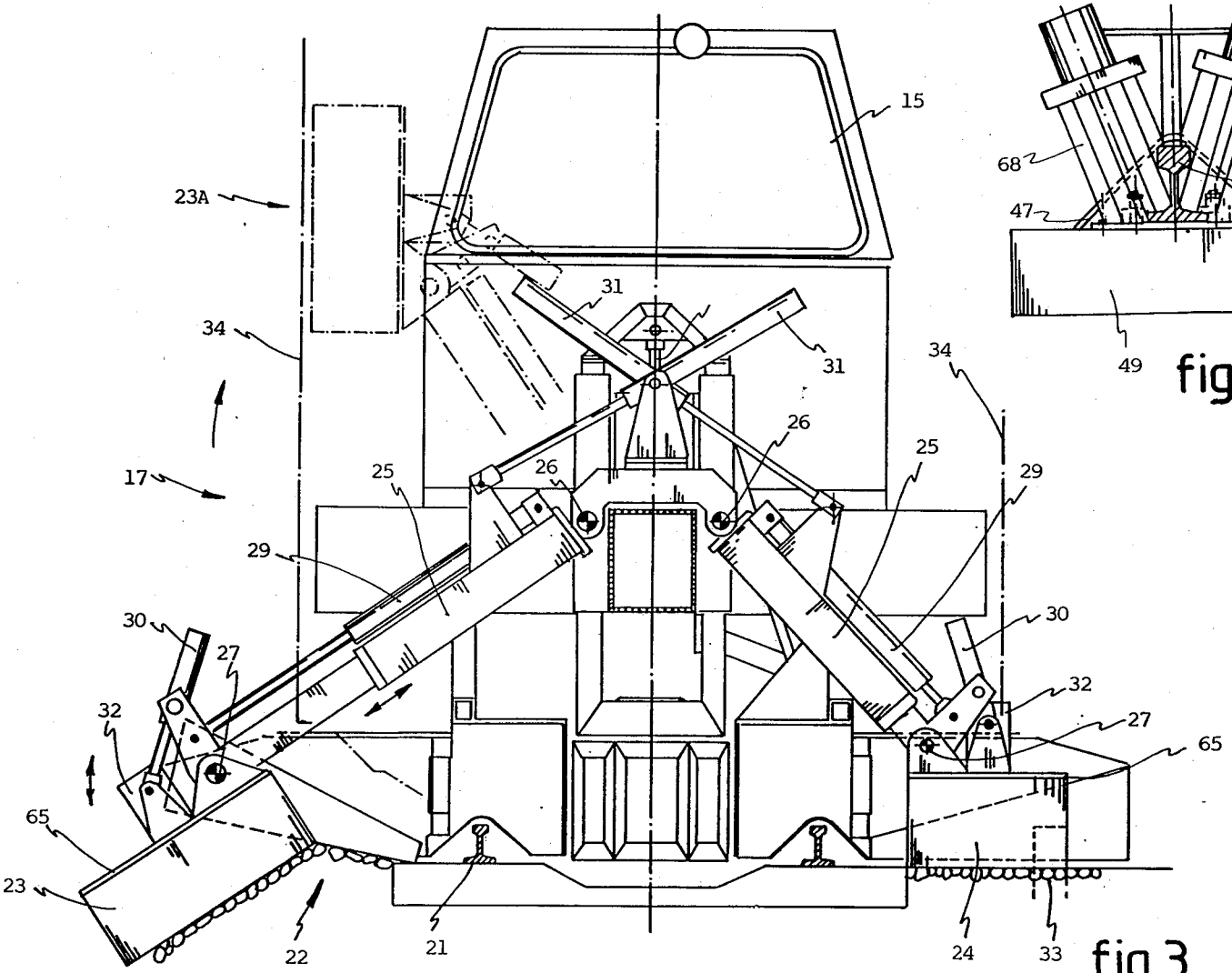
FIG. 3 is a cross sectional view long A—A of FIG. 1.

This unit 17 is shown in greater detail in FIG. 3, where it is possible to see that there are a rotatable drum 23 and a rotatable drum 24 respectively at the two sides of the machine 10.

The drives of these drums 23–24 are independent and the driver 16 can therefore work with only one of them or with both as required. Both drums 23–24 will work advantageously during normal functioning.

These drums 23–24 can be equipped with suitable frontal and/or peripheral means, such as blades, teeth or other means, able to move the ballast of which a road bed 22 consists.

In the example shown the rotatable drums 23–24 have different diameters. The smaller drum 24 is suitable for employment in the portion of the road bed between two neighbouring railway lines 20, that is, between two or multiple railway tracks.

The purpose of this is to enable pegs or stakes 33 that mark the line to be avoided easily by sideways displacement, this being a thing which cannot be done easily with a big drum.

Moreover, the drum 24 in its working position always remains within the working gauge laid down so as not to come into contact with trains passing on the neighbouring line.

As can be seen, the drum 23 or 24 is upheld on a support plate 65, which in turn is suspended rotatably at 27 on a telescopic arm 25, which can be extended by an actuator 29, which in this instance is a jack.

The arm 25 in turn is pivoted at 26 and can be overturned by an actuator 31, which here is also a jack.

The drum 23 or 24 can be adjusted for inclination by being rotated about the pivot 27 by means of an actuator 30, which in this example also consists of a jack. The drums 23–24 can both be adjusted in the same way.

It will perhaps be possible to instal drums 23–24 having the same diameter, and this will be advantageous where there is only one railway line.

A position 23A for movement of the drum 23 from one working area to another is shown with lines of dots and dashes towards the top left corner of FIG. 3. Such position 23A remains within the gauge laid down for movement of the machine 10, the gauge being indicated at 34 with lines of dots and dashes.

The ability to regulate according to the invention the inclination, height and sideways extent of the drums 23–24, which work advantageously at the same time as each other, enables any profile of road bed 22 at the sides of the railway line 20 to be obtained easily.

Figure 4:
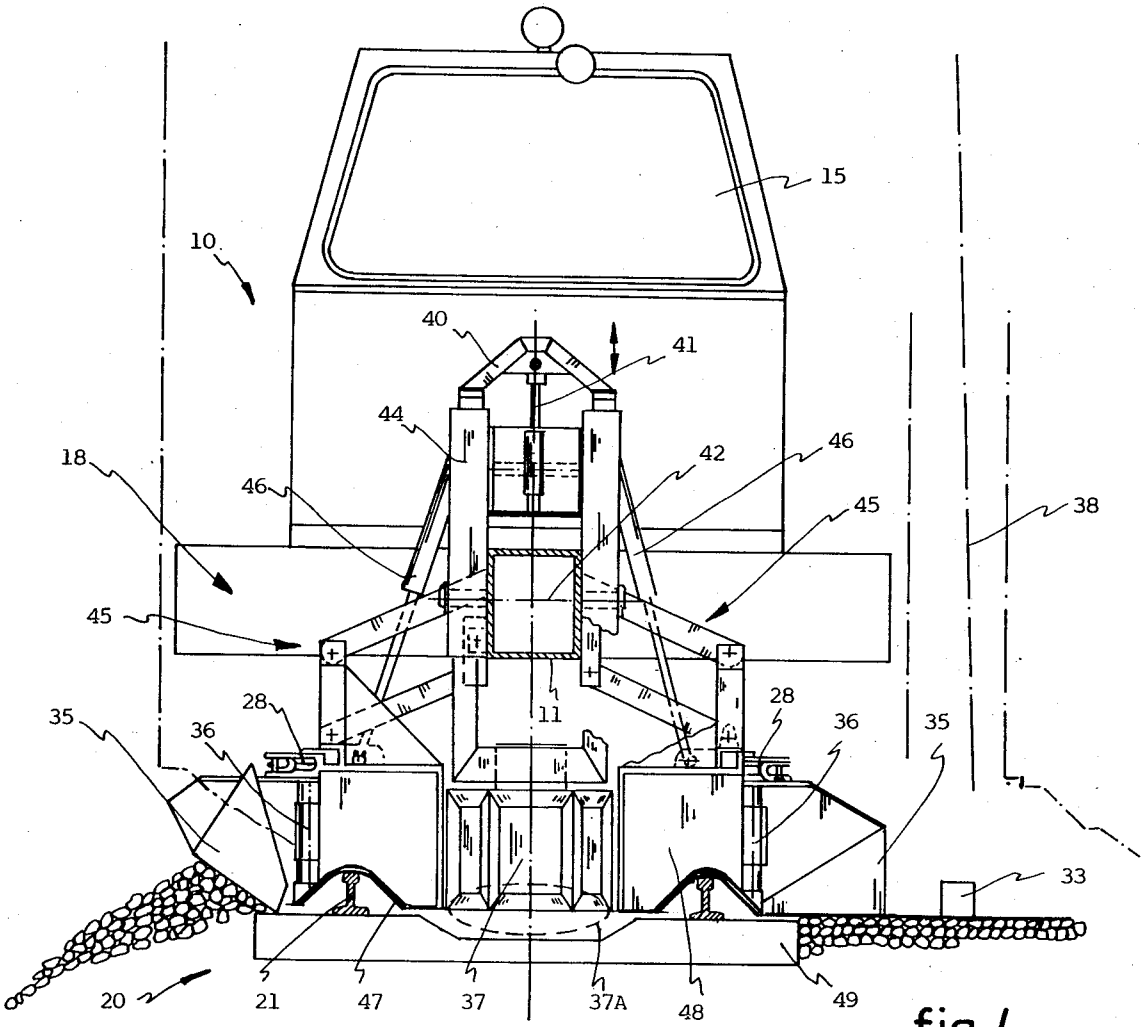
FIG. 4 is a cross sectional view along B—B of FIG. 1.

FIG. 4 shows the central transfer unit 18 in greater detail. In this figure the unit 18 comprises two orientable plough blades 35, which are shown here in their working position (see also FIG. 2).

These blades 35 are rotatably supported on an axis 36, each being held on a support element 48, here a box-type element.

Actuator means 28, consisting of a jack in this example, enable each blade 35 to be rotated about an axis 36 so as to obtain the required forwards or backwards orientation of such blades 35 (see also FIG. 2).

The blades 35 can be the same or have different forms, depending on the profile to be given to the road bed 22 and on the specific requirements.

Several interchangeable blades 35 having various forms can be provided as a kit with the machine 10.

Vertical adjustment of the blades 35 can be performed by lowering or raising the support elements 48, each of which is connected to the frame 11 of the machine 10 by arms 45 arranged in a parallelogram. An actuator 46, in this case a jack, serves to regulate the height of such elements 48.

Bridge elements 47, which are shown also in FIGS. 1 and 2, serve, as described in the first part of this description, to enable the ballast lifted by the blades 35 to be transferred into or out of the inner side of the railway line 20 by passing over rails 21.

Adjustment of the inclination and height of the central blades 35 is carried out directly by the driver 16, who supervises from his cab 15 with glass windows the operation of transfer of ballast.

A transfer drum 37 is included in the centre of the machine 10 between the two support elements 48. This drum 37 is arranged to be rotatable and to be supported on a support structure 40, which can slide vertically within guides 44.

Adjustment of the height of the structure 40 and therefore of the drum 37 is performed by means of an actuator 41, which here too consists of a jack.

The guides 44 in turn can rotate about an axis 42 in relation to the frame 11. In this way the guides 44 and with them the slidable structure 40 can be so oriented as to tilt the drum 37 in relation to the vertical when so required.

Such orientation is performed by an actuator 43, which in this example is a jack. In this way a working effect of the drum 37 is obtained in depth, and the drum 37 has a working profile which is no longer flat but is convex towards sleepers 49 and follows the recessed shape of such sleepers 49.

In this way, as is shown with a line of dashes as position 37A in FIG. 4, the drum 37 can scrape and transfer the ballast contained in the central portion of the sleeper 49. This is especially useful with recessed concrete sleepers.

Such scraping of the ballast facilitates the work of brushing in the central zone of the railway line 20.

The combined action of the blades 35 and drum 37 in cooperation with the bridge elements 47 enables the ballast to be transferred from one side of the railway line 20 to the other in one single pass.

Figure 5:
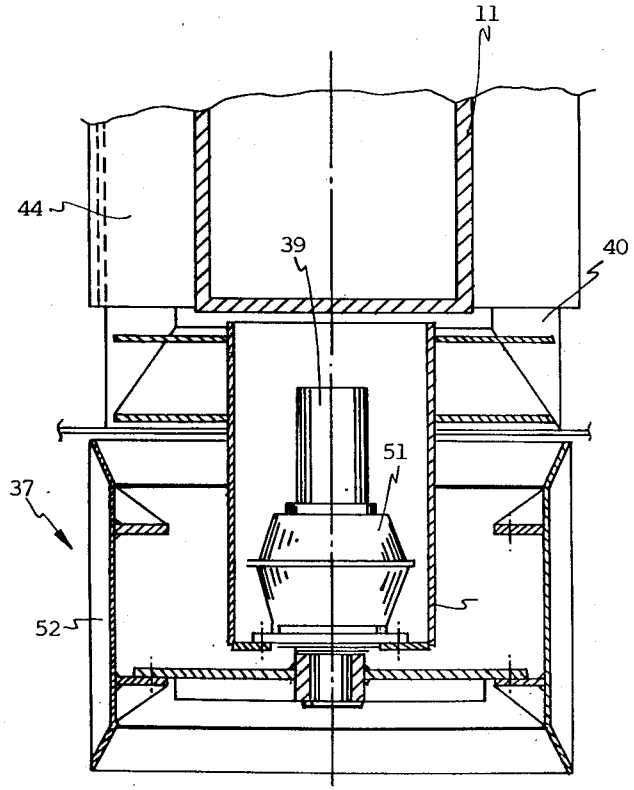
FIG. 5 shows a detail of the central drum.

FIG. 5 shows the drum 37 more clearly. Such drum 37 is hollow; a support element 50 to which a motor 39-reduction gear 51 unit is flanged is partly lodged within the drum 37, which is directly keyed to the output shaft of the reduction gear 51. The motor 39 is advantageously hydraulic.

The periphery of the drum 37 is equipped with blades 52, which have the task of facilitating transfer of ballast from one side to the other.

The direction of motion of the motor 39 and therefore of the drum 37 can, of course, be reversed.

In the example of FIG. 5 the drum 37 is shown in its most highly raised position in relation to the frame 11 of the machine 10, having been thus raised by the actuator 41 (see FIG. 4).

Figure 6:
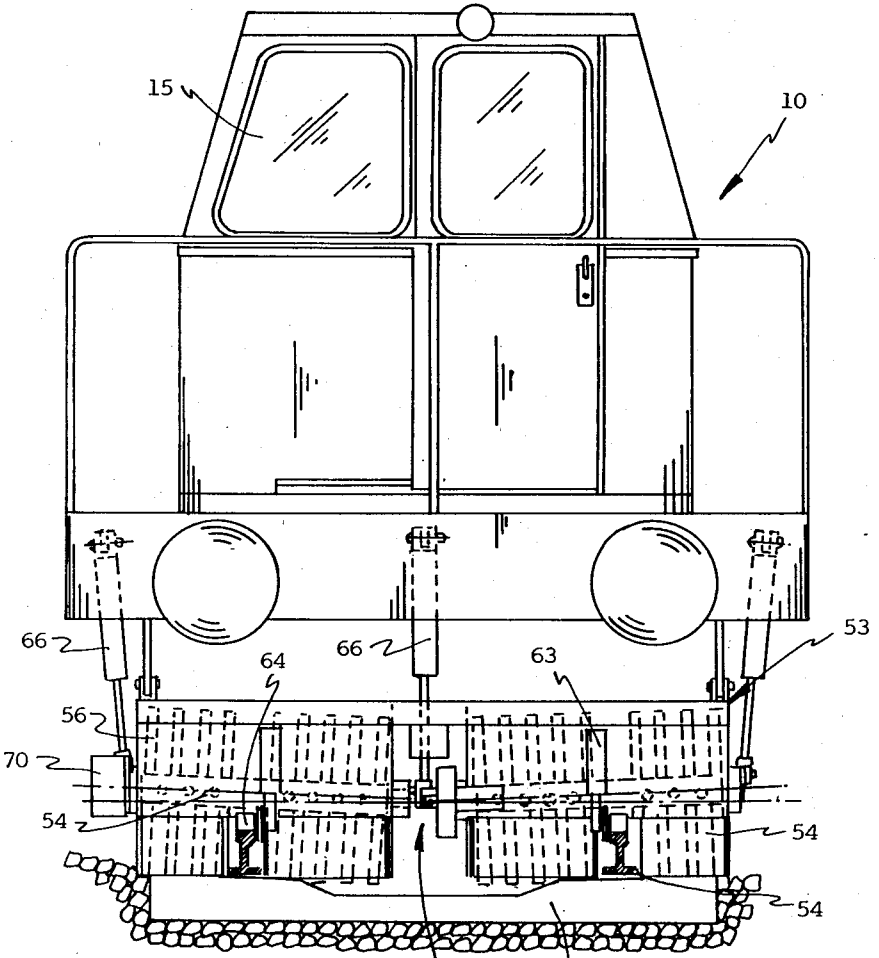
FIG. 6 is a rear view of the dressing machine.

FIG. 6 gives a rear view of the machine 10; this view shows a rotatable brush 53, which according to the invention consists of several rotatable elements 54 connected together in an articulated manner.

In this example such elements 54 are two in number, and each of them comprises a plurality of elongated elements 56.

Such elements 56 are made advantageously of a flexible material such as rubber or the like.

The two rotatable elements 54 are united by a universal joint 55. In this way the brush 53 is articulated and can be adapted to the shape of the sleeper 49 with an action which follows the recessed profile of the sleeper 49.

Drive means 66, which in this example are jack means, adjust the inclination of the brush elements 54 during work and serve also to take the brush elements 54 upwards out of work for movement to another area.

The brush elements 54 are driven by a motor which in this example is a hydraulic motor 70.

FIGS. 1 and 2 show how the rotatable brush 53 cooperates with a central cleaner means 57, which in this example consists of a central blade and is especially suitable for two-piece sleepers 49. The height of the means 57 can be adjusted by an actuator 58, which here too is a jack.

The ballast thrown up and lifted by the blade 57 is collected thereafter by the brush 53. Such ballast lifted by the rotatable brush 53 ascends a ramp 60 and is withdrawn sideways by a conveyor or ramp 59.

A rotatable brush of small dimensions, which is not shown here, may possibly be provided instead of the blade 57. Such brush will also be advantageously adjustable in height (by the actuator 58) independently of the brush 53.

A stationary brush 61 to clean the zone of attachments can also be seen if FIG. 1 at the extreme rear end of the machine 10. Such brush 61 is kept in position by actuator means 62 such as a jack or an electromagnetic actuator.

The brushes 53 and 61 are raised by the actuators 66–62 when the machine 10 is moving from one working position to another. In this way the brushes 53 and 61 remain within the gauge laid down during such movement of the machine 10.

Thr brush 53 is aligned with the railway line 20 by means of supports 63 connected to support wheels 64, which are flanged so as to permit excellent alignment with the railway line 20.

Figure 7:
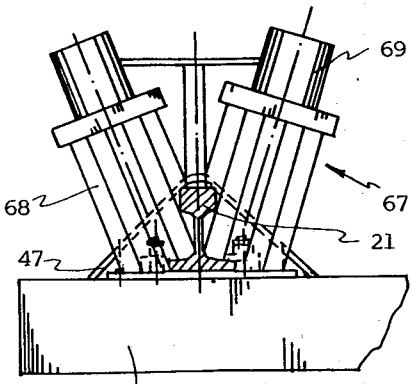
FIG. 7 shows auxiliary brush means.

FIG. 7 shows another type of auxiliary brush means 67 to clean attachments. Such brush means 67 consist of flexible vanes 68 which are advantageously vibratable and are supported by vibrator means 69.

The vanes 68 can be flat or tubular and tilted (see FIG. 7) or upright, or partly tilted and partly upright.

In the example of FIG. 2 the auxiliary brush means 67 are located in front of the ramps or bridge elements 47, the purpose being to prevent the ballast becoming wedged below such bridge elements 47. Such means 67 may possibly be envisaged as cooperating with one or both bogies 12-13.

We have described here a preferred embodiment of this invention, but many variants are possible without departing thereby from the scope of the invention.

Thus it is possible to modify the shapes and sizes of the parts and positions of the work units and to replace the actuator means with equivalent means of a pneumatic, hydraulic, mechanical, electromagnetic, etc. type.

It is possible to envisage the blades 35 and drums 23-24-37 having conformations other than those shown.

It is also possible to arrange for auxiliary means, such as blades or ridges on the drum means 23-24-37, and elongated elements 56 having shapes and sizes other than those shown.

These and other variants are all possible for a person skilled in this field without departing thereby from the scope of the invention.

INDEX

10—dressing and re-distributing machine
11—frame
12—front axle or bogie
13—rear axle or bogie
14—motor unit
15—cab
16—driver
17—lateral forming unit
18—central transfer unit
19—brush unit
20—railway line
21—rails
22—road bed
23—forming drum
23A—position for movement
24—forming drum
25—telescopic arm
26—pivot
27—pivot
28—actuator or jack
29—actuator or jack
30—actuator or jack
31—actuator or jack
32—motor
33—stakes
34—clearance gauge
35—plough blades
36—axis
37—rotatable transfer drum
37A—tilted position of drum
38—clearance gauge
39—motor
40—support structure
41—actuator or jack
42—axis of rotation
43—actuator or jack
44—guides
45—arms arranged in a parallelogram
46—actuator or jack
47—bridge elements
48—support elements
49—sleeper
50—support of motor
51—reduction gear
52—blades
53—rotatable brush
54—rotatable elements
55—universal joint
56—elongated elements
57—central cleaner means
58—actuator or jack
59—conveyor or ramp
60—ramp
61—brush for zone of attachments
62—actuator means
63—support for wheels
64—support wheels
65—support plate
66—drive means
67—auxiliary brush means
68—vanes
69—vibrator means
70—motor.

I claim:

1. A machine for dressing and distributing railway road bed ballast, comprising a frame having forward and rear ends;

wheels for supporting the frame and engaging rails of a railway;

a dressing unit located near the front end of the frame, comprising:

first and second support arms extending laterally from opposite sides of the frame, vertically adjustable with respect to the frame, each arm extending a variable distance outwardly from the frame; and first and second rotary lateral dressing drums pivotably secured to the first and second support arms for shaping ballast at the sides of a railway;

a redistributing unit located rearwardly of the dressing unit, comprising:

third and fourth support arms extending laterally from opposite sides of the frame, vertically adjustable with respect to the frame;

first and second ploughs pivotably secured to the third and fourth support arms, said ploughs being pivotable in a horizontal direction;

a drum support, tiltable in a longitudinal direction with respect to the frame;

a transfer drum carried by said support, said transfer drum being vertically adjustable with respect to the frame, oriented to have a vertical axis which is tiltable with the drum support, and disposed beneath the frame and between the first and second ploughs; and bridge elements for overlying rails of a railway to facilitate transfer of ballast over the rails; and a brush unit located rearwardly of the redistributing unit, comprising:

a central cleaning unit vertically adjustably secured to the frame, disposed beneath the frame;

a rotary brush for engaging material thrown up by the central cleaning unit, and having a substantially horizontal axis; and a chute means for collecting material engaged by the brush.

2. The machine of claim 1, wherein the dressing drums comprise blades for moving ballast.

3. The machine of claim 1, further comprising drive means allowing independent operation of the first and second dressing drums.

4. The machine of claim 1, wherein the dressing drums are of different diameter.

5. The machine of claim 1, wherein the central cleaning unit comprises a plough.

6. The machine of claim 1, wherein the central cleaning unit comprises a brush.

7. The machine of claim 1, wherein the brush unit further comprises a stationary brush to clean the attachments of the railway.

8. The machine of claim 1, wherein the rotary brush comprises two rotary elements joined by a universal joint.

9. The machine of claim 1, wherein each dressing drum rotates about an axis substantially perpendicular to the ballast being shaped by the drum.

* * * * *

UNITED STATES PATENT AND TRADEMARK OFFICE

CERTIFICATE OF CORRECTION

PATENT NO. : 4,707,935

DATED : November 24, 1987

INVENTOR(S) : Ivo CICIN-SAIN

It is certified that error appears in the above-identified patent and that said Letters Patent is hereby corrected as shown below: On the title page In the Assignees, please change "CLM Impianti Tecnici Industriali SpA" to --ITI/CLM Impianti Tecnici Industriali SpA--.

Signed and Sealed this

Tenth Day of May, 1988

*Attest:*

*Attesting Officer*

DONALD J. QUIGG

*Commissioner of Patents and Trademarks*